US012303003B2

(12) United States Patent
Querry et al.

(10) Patent No.: US 12,303,003 B2
(45) Date of Patent: May 20, 2025

(54) FRAME FOR BAD WEATHER AND/OR SUN PROTECTION DEVICE

(71) Applicant: Eric Chevillard, Hong-Kong (CN)

(72) Inventors: Hector Querry, La Neuveville (CH); Jean-Luc Thuliez, Le Landeron (CH); Etienne Crozier, La Neuveville (CH); Robin Zimmermann, La Neuveville (CH); Guillaume Heisel, Bienne (CH)

(73) Assignee: Eric Chevillard, Hong-Kong (CN)

( * ) Notice: Subject to any disclaimer, the term of this patent is extended or adjusted under 35 U.S.C. 154(b) by 411 days.

(21) Appl. No.: 17/640,692

(22) PCT Filed: Sep. 6, 2019

(86) PCT No.: PCT/EP2019/073882
§ 371 (c)(1),
(2) Date: Mar. 4, 2022

(87) PCT Pub. No.: WO2021/043426
PCT Pub. Date: Mar. 11, 2021

(65) Prior Publication Data

US 2022/0338602 A1 Oct. 27, 2022

(51) Int. Cl.
*A45B 19/10* (2006.01)
*A45B 23/00* (2006.01)
(Continued)

(52) U.S. Cl.
CPC ..... *A45B 19/10* (2013.01); *A45B 25/02* (2013.01); *A45B 25/24* (2013.01); *A45B 19/04* (2013.01);
(Continued)

(58) Field of Classification Search
None
See application file for complete search history.

(56) References Cited

U.S. PATENT DOCUMENTS 2,264,881 A * 12/1941 Cam ..... A45B 25/18
135/25.32
3,431,925 A * 3/1969 Kraft ..... A45B 25/02
135/25.31
(Continued)

FOREIGN PATENT DOCUMENTS

GB 2086722 A * 5/1982 ..... A45B 19/10
GB 2397223 A 7/2004
(Continued)

OTHER PUBLICATIONS

International Search Report mailed May 6, 2020, issued in corresponding International Application No. PCT/EP2019/073882, filed Sep. 6, 2019, 2 pages.
(Continued)

*Primary Examiner* — David R Dunn
*Assistant Examiner* — Danielle Jackson
(74) *Attorney, Agent, or Firm* — Christensen O'Connor Johnson Kindness PLLC

(57) ABSTRACT

A deployable frame for a weather and/or sun protection device, including: a mast with a longitudinal axis on which a slider is mounted so as to slide between a first position in which the frame is closed and a second position in which the frame is open; at least one rib connected by a stretcher to the runner, the rib including an end connected to a notch carried by one end of the mast, wherein the rib includes a first segment formed of a first part and a second part that are movable relative to each other about the extension axis of the first segment, the first part of the first segment of the rib is connected to the notch by a pivot connection about an axis which is perpendicular to a plane inclined obliquely to the longitudinal axis of the mast so that in the first closed position of the frame the first segment of the rib extends
(Continued)

along the mast and in the second open position of the frame the first segment of the rib is moved away from the mast.

25 Claims, 10 Drawing Sheets

(51) Int. Cl.
*A45B 25/02* (2006.01)
*A45B 25/24* (2006.01)
*A45B 19/04* (2006.01)

(52) U.S. Cl.
CPC ..... *A45B 2023/0006* (2013.01); *A45B 2200/1081* (2013.01)

(56) References Cited

U.S. PATENT DOCUMENTS 3,590,865 A * 7/1971 Bremshey ..... A45B 19/04 135/26
3,593,731 A * 7/1971 Schultes ..... A45B 25/06 135/29
3,613,702 A * 10/1971 Weber ..... A45B 25/10 135/33.4
3,831,613 A * 8/1974 Weber ..... A45B 25/06 135/25.1
4,542,758 A * 9/1985 Okuda ..... A45B 25/02 135/25.3
4,815,489 A * 3/1989 Yang ..... A45B 25/006 135/25.3
5,533,535 A * 7/1996 Lin ..... A45B 19/00 135/25.4
5,615,697 A * 4/1997 Lin ..... A45B 19/10 135/25.1
5,706,844 A * 1/1998 Lin ..... A45B 19/00 135/25.4
5,855,220 A * 1/1999 Wu ..... A45B 25/02 135/31
5,975,099 A * 11/1999 Johnson ..... A45B 25/02 135/31
6,334,454 B1 * 1/2002 Williams ..... A45B 25/24 135/18
6,626,199 B2 * 9/2003 Lin ..... A45B 25/06 135/20.1
7,174,906 B2 * 2/2007 Ko ..... A45B 19/12 135/31
7,513,266 B2 * 4/2009 Hayashi ..... A45B 19/10 135/25.1
8,800,577 B2 * 8/2014 Ma ..... A45B 25/02 135/15.1
2003/0164184 A1 * 9/2003 Lin ..... A45B 19/10 135/25.3
2005/0081901 A1 * 4/2005 Ko ..... A45B 25/02 135/31
2005/0211283 A1 * 9/2005 Lai ..... A45B 19/10 135/31
2006/0107981 A1 * 5/2006 Ko ..... A45B 19/10 135/25.3
2006/0118152 A1 * 6/2006 Ko ..... A45B 19/10 135/25.3
2006/0118153 A1 * 6/2006 Ko ..... A45B 19/10 135/31
2006/0207639 A1 * 9/2006 Ko ..... A45B 19/10 135/25.3
2006/0272689 A1 * 12/2006 Ko ..... A45B 19/10 135/25.1
2007/0062566 A1 * 3/2007 Liu ..... A45B 19/10 135/25.1
2007/0095373 A1 * 5/2007 Lin ..... A45B 19/10 135/25.4
2008/0066792 A1 * 3/2008 Chen ..... A45B 19/10 135/31

FOREIGN PATENT DOCUMENTS

GB 2430361 A 3/2007
JP S5040461 U 4/1975
KR 20100110701 A 10/2013

OTHER PUBLICATIONS

Written Opinion of the International Searching Authority mailed May 6, 2020, issued in corresponding International Application No. PCT/EP2019/073882, filed Sep. 6, 2019, 7 pages.
International Preliminary Report on Patentability mailed Mar. 8, 2022, issued in corresponding International Application No. PCT/EP2019/073882, filed Sep. 6, 2019, 1 page.

* cited by examiner

FRAME FOR BAD WEATHER AND/OR SUN PROTECTION DEVICE

TECHNICAL FIELD

Embodiments of the disclosure relate to the devices of protection of the bad weather and/or the sun.

BACKGROUND

Classically, a device for protection against the bad weather and/or the sunlight, such as an umbrella, a parasol or a sunshade, comprises a frame comprising a mast which may or may not be telescopic, on which a runner is mounted so that it can slide between a first position in which the device is closed and a position in which the device is open. The frame comprises ribs connected to a notch or support attached to one end of the mast and to the runner by means of stretchers or sub-ribs.

In one embodiment, it has been proposed to attach the ends of the ribs to a circumferential wire integral with the notch. The ends of the stretchers opposite to those connected to the ribs are connected to the runner by another circumferential wire integral with the runner. The deployment of the frame is achieved by sliding the runner which induces a deployment of the ribs. The angular spacing of the ribs is obtained by the tensioning of the protective fabric fixed to the ribs and by the connection by wire of the ribs and the stretchers which authorize an angulation of the ribs the ones relatively to the others. If this type of system can be very compact in closed position, it proves in practice to be very fragile to use because of the not very rigid connections, on the one hand, of the stretchers to the runner and, on the other hand, of the ribs to the notch.

Note that a weather protection device has the primary function of protecting from rain but can also be used to protect from the sun. Also a sun protection device that has the primary function of protecting from the sun can also be used to protect occasionally from the rain.

Also, a protective device as described above and used in its function of protection from the weather, necessarily turns out to be wet when it is closed again immediately after use in the rain for example. Thus, when the user arrives at a given location (restaurant, work, . . . ) it is known to place the device in a receiving container, for example cylindrical, allowing water to flow downwards to allow drying of the device fabric. Another method consists in deploying the device in a dry place (garage, covered terrace, . . . ) in order to carry out the drying of the fabric. It is understood that either method requires the device to be stored for a fairly long period of time and does not make it possible for the user to carry the device in a closed state due to the presence of water drops on the fabric, in a bag for example, the surrounding belongings then being wet.

Embodiments of the disclosure aim to remedy all or part of the above-mentioned problems and drawbacks in a simple and reliable manner.

SUMMARY

Thus, the present document relates to a deployable frame, in particular for a weather and/or sun protection device, comprising:

a mast with a longitudinal axis on which is mounted a slider that slides between a first position in which the frame is closed and a second position in which the frame is open;

at least one rib connected by a stretcher to the runner, the rib comprising an end connected to a notch carried by one end of the mast, wherein:

the rib comprises a first segment formed by a first part and a second part that are movable with respect to each other about the extension axis of the first segment, the first part of the first segment of the rib is connected to the notch by a pivot connection about an axis which is perpendicular to a plane inclined obliquely to the longitudinal axis of the mast so that in the first closed position of the frame the first segment of the rib extends along the mast and in the second open position of the frame the first segment of the rib is moved away from the mast.

According to the proposed configuration, when the frame is deployed, the first segment articulated by a pivot connection to the notch can thus move away from the mast by pivoting around an oblique axis, while the second part of the segment can move away from the mast while performing a rotational movement around the extension axis of the first segment. Thus, the attachment of a protective cloth can be fixed to the second part of the first segment and the cloth does not undergo a rotational movement around the axis of the segment. Moreover, the mechanical connection of the first segment to the notch allows to guarantee an increased rigidity of the connection of the rib to the notch compared to the previous technique while ensuring a distance of the rib from the mast when the frame is in its second opening position.

According to another characteristic, a first end of the stretcher can be connected to the runner by a ball-and-socket connection. It could also be connected to the mast via a circumferential wire integral with the runner.

The ball-and-socket connection may comprise a spherical part carried by the first end of the stretcher and housed in a cavity of complementary shape of the runner. The reverse would also be possible, i.e. a cavity carried by the first end of the stretcher and a spherical part carried by the runner.

A second end of the stretcher can be pivotally connected to the second part of the first segment of the rib. In combination with the ball-and-socket connection of the first end of the stretcher, this configuration provides further increased rigidity of the rib/stretcher assembly due to the absence of circumferential play, i.e. around the axis of the mast, of the first end of the rib with the runner.

Also, elastic means can be configured to exert a force tending to deploy the frame when it is in its first position. In particular, they may comprise an elastic member interposed between the first segment and the mast when the frame is in its first closed position.

The elastic member may comprise a tongue carried by the stretcher and elastically constrained between the stretcher and the mast when the frame is in its first position. In this way, the tongue exerts a force tending to deploy the frame, allowing to facilitate the initial deployment movement of the frame by performing an automatic pre-deployment thereof.

In one embodiment of a rib for a deployable frame as described herein but which may also be used in other deployable frames not having the aforementioned specifics, each rib may comprise n segments S arranged at the end of each other from the first segment $S_1$ to an n-th end segment $S_n$, and wherein:

for any $k \in [2, n-1]$ the k-th segment $S_k$ is connected to the segment $S_{k-1}$ by a pivot axis $P_{S_{k-1}/S_k}$ and is connected to the segment $S_{k+1}$ by a pivot axis $P_{S_k/S_{k+1}}$, a rod $T_k$ is associated with the segment $S_k$ and is connected by a pivot axis $P_{T_k/S_{k-1}}$ and by a pivot axis $P_{T_k/S_{k+1}}$ respectively, to the segment $S_{k-1}$ and to the segment $S_{k+1}$ in such a way that each segment $S_k$ together with a rod $T_k$ forms a deformable parallelogram.

Each k-th rod $T_k$ may comprise a bulge $R_{T_k}$ for receiving the pivot axis $P_{T_{k+1}/S_k}$ and the pivot axis $P_{S_k/S_{k+1}}$ when the frame is in its first position. Each k-th segment $S_k$ comprises a bulge $R_{S_k}$ for receiving the pivot axis $P_{T_k/S_{k-1}}$ when the frame is in its first position. These bulges make it possible to obtain an increased compactness of the rib when the frame is in its first position, i.e. when the segments of the rib are folded on each other.

The pivot axes $P_{T_k/S_{k-1}}$, $P_{S_k/S_{k-1}}$ and $P_{T_{k-1}/S_{kk}}$ can be positioned relative to each other such that the pivot axes are substantially aligned when the frame is in its first position, the pivot axis $P_{S_k/S_{k-1}}$ being positioned between the pivot axis $P_{T_k/S_{k-1}}$ and the pivot axis $P_{S_{k-1}/S_k}$.

The frame may comprise a first rod $T_1$ pivotally connected to the stretcher and pivotally connected to the second segment $S_2$ by a pivot axis $P_{T_1/S_2}$.

The first rod $T_1$ may comprise a bulge $R_1$ for receiving the pivot axis $P_{S_1/S_2}$ and the pivot axis $P_{T_2/S_1}$.

Thus, the present document also relates to a rib as such, which rib may comprise a first one-piece segment, i.e., not comprising a first part and a second part rotatable relative to each other.

In a more particular configuration, the frame may comprise a first rib and a second rib as described above, the first rib being symmetrical to the second rib about a plane containing the longitudinal axis of the mast and passing between the first rib and the second rib.

The axis of the pivot connection of the first rib and the axis of the pivot connection of the second rib can be contained in the same plane parallel to the longitudinal axis of the mast.

Similarly, the frame may comprise a third rib and a fourth rib of the type recited above, the third rib being symmetrical to the fourth rib about a plane containing the longitudinal axis of the mast and passing between the third rib and the fourth rib.

The axis of the pivot connection of the third rib and the axis of the pivot connection of the fourth rib can be contained in the same plane parallel to the longitudinal axis of the mast.

The first rib may be symmetrical to the third rib with respect to a plane containing the longitudinal axis of the mast and passing between the first rib and the third rib.

The second rib may be symmetrical to the fourth rib with respect to a plane containing the longitudinal axis of the mast and passing between the second rib and the fourth rib.

The mast may have a generally oblong cross-section with two opposing surfaces connected to each other by two rounded surfaces.

More particularly, the mast may have two flat surfaces substantially parallel to each other and to the longitudinal axis, the two flat surfaces being connected to each other by joining portions which may be straight circular half-cylinders with generatrices parallel to the axis of the mast. Obviously, this shape is a particular shape falling within the definition of a general oblong shape within the meaning of the present disclosure. Thus, one and/or other of the planar surfaces could be replaced by a non-planar surface and the half-cylinders could have non-spherical rounded shapes. For example, one of the four aforementioned surfaces could have a groove from one end of the mast to the other to facilitate sliding cooperation of unitary elements forming a telescopic mast.

The axis of the pivot connection of the first rib and the axis of the pivot connection of the second rib can be arranged in the vicinity of one of the two rounded surfaces. In this configuration, the first rib and the second rib are thus arranged side by side when the frame is in its first closed position. It would also be possible to have the axis of the pivot connection of the third rib and the axis of the pivot connection of the fourth rib arranged in the vicinity of the other of the two rounded surfaces. In this manner, the third rib and the fourth rib are arranged side by side when the frame is in its first closed position. It is understood that the frame thus offers, seen from above, i.e. along the axis of the mast and from the notch, a substantially rectangular general shape when it is in its second position, each rib being arranged in the corners of the rectangular shape.

The present document also relates to a weather conditions and/or sun protection device comprising at least one frame as described above, and a protective cloth attached to the frame so as to be tensioned when the frame is brought into its second position.

A handle element can be mounted at an end of the mast opposite to the one receiving the notch.

The device may include a case adapted to be mounted around the frame when the frame is in its first closed position, the case sealingly engaging the handle member to form a sealed casing.

As will be understood, the present disclosure of the frame is usable, in particular, in a weather protection device such as rain or in a sun protection device such as a sunshade, which are transportable or portable devices. It is also applicable to non-transportable devices that would use the same operating principle.

The present disclosure therefore also applies to protective devices comprising a single rib or only two or three ribs.

Independently or in combination with any of the previously described features, the present disclosure also relates to a weather and/or sun protection device, comprising:

a frame deployable between a first position in which the frame is closed and a second position in which the frame is open, the frame supporting a protective fabric;

a mast with a longitudinal axis (L) on which a runner is intended to be mounted, capable of deploying the frame by sliding along the mast;

a handle element carried by one end of the mast;

characterized in that it comprises a case in which all or part of the deployable frame is able to be housed when the latter is in its first closed position and in that the case and the handle element are configured to cooperate in a sealed manner with each other when the frame is in its first position so as to form a sealed casing.

This specific assembly makes it possible to achieve a watertightness of the casing formed by the case and the handle element. In this way, the user can easily transport the device and place it in a bag or any other container suitable for receiving it without the objects or belongings in the container or the walls of the container getting wet.

The device can be shaped to fit in a trouser pocket or in an inner pocket of a suit jacket and it is easy to understand the interest for a user to keep his protection device with him without having to worry about where he has placed it and having to think about retrieving it, the device accompanying him in the same way as his other things.

As mentioned, the use of a waterproof casing can be achieved with the deployable frame described above, so that the protective device can then be extremely compact.

According to another feature of the present document, at least one sealing piece may be interposed between the case and the handle element. The at least one sealing member may be an annular seal that may be closed or open contour, i.e., slotted, depending on the conformation of the case.

Also, one of the case and the handle element includes at least one movable member that is movable between a first position for sealingly locking the handle element to the case and a second unlocking position for disengaging the handle element from the case.

Alternatively, the case may include a fixed portion and the movable member that is articulated for movement relative to the fixed portion between the first position and the second position. In this configuration, the movable member forms at least a portion of the removable case relative to the handle element. In another configuration, the movable member comprises a fixed portion and a movable portion.

The term "fixed" here refers to a portion of the case or handle member that does not move relative to the handle member or case, respectively, when the fixed portion is brought into a position capable of being locked or unlocked. In this position, the movable part is movable between its two locking and unlocking positions.

The device may include guiding means configured to allow movement of the movable member between the first locking position and the second unlocking position.

The guiding means may comprise at least one rod carried by the fixed part of the case and at least one housing in which the rod is engaged to guide the movement of the rod in the housing.

The movable member may comprise two opposing webs each having a housing, the at least one rod being engaged in the housings of the two webs.

The at least one groove may be shaped to allow translation of the movable member from the first position to an intermediate position and then to allow pivoting of the webs of the movable member to a position corresponding to the second position of the movable member.

The movable member may comprise a first upper hook adapted to cooperate by elastic snap-fastening with a first hook of complementary shape of the fixed part of the case when the movable member is in its first position so as to block the movable member on the fixed part of the case along the longitudinal direction.

The movable member may comprise a second lower hook adapted to cooperate by elastic snap-fastening with a second hook of complementary shape of the handle element when the movable member is in its first position so as to block a movement of the movable member in a direction perpendicular to the longitudinal direction.

The case may comprise a first movable member and a second movable member of the aforementioned type, the first movable member and the second movable member being arranged relative to each other so that they move away from each other from their first position to their second position.

DETAILED DESCRIPTION

Figure 1:
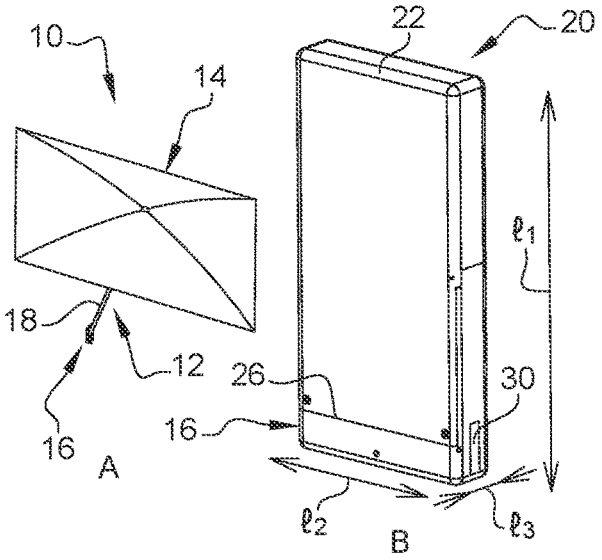
FIG. 1 comprises two parts A and B, named respectively, FIG. 1A and FIG. 1B, FIG. 1A representing a device for protection against the bad weather and/or the sunlight integrating a deployable frame and FIG. 1B representing an assembly comprising a device according to FIG. 1A with the frame housed in a case.
Figure 2:
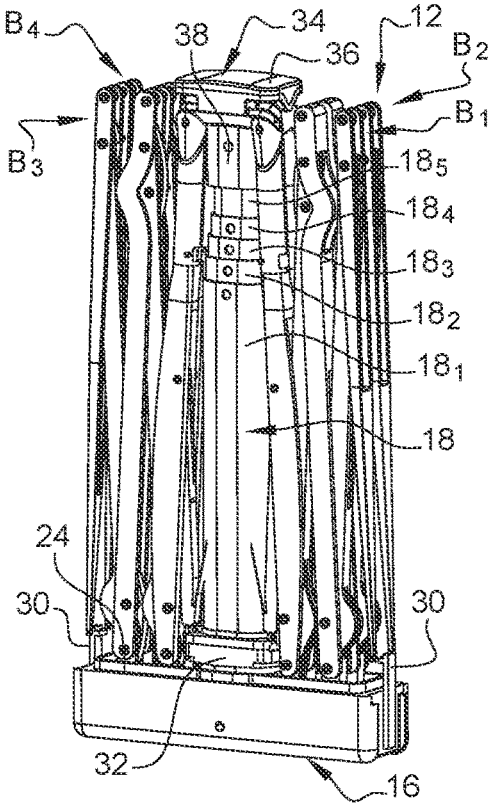
FIG. 2 is a schematic perspective view of the frame of the device of FIG. 2 in which the case has been removed, the umbrella being in a first closed position and the canvas not being shown to facilitate visualization of the frame.
Figure 3:
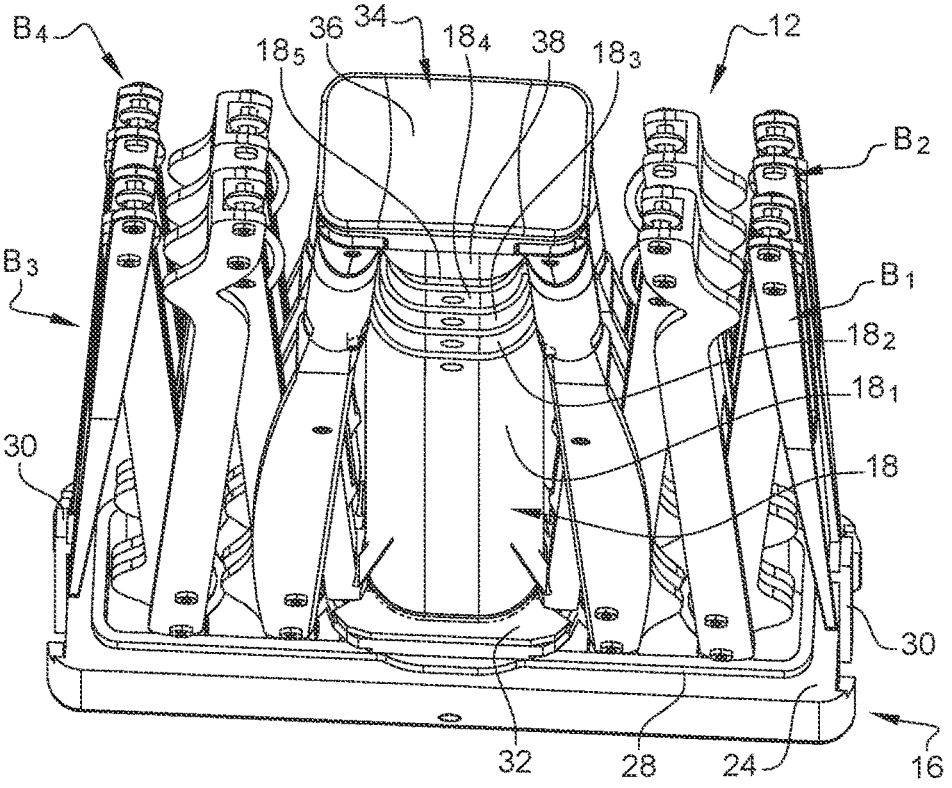
FIG. 3 is a view of the device in FIG. 2 at a different angular orientation.

FIG. 1 includes a first portion named FIG. 1A and a second portion named FIG. 1B. FIG. 1A depicts a bad weather and/or sunlight protection device 10 comprising a deployable frame 12 having a protective fabric 14 attached thereto and a handle member 16 that is attached to one end of a mast 18 of the frame 12. FIG. 1B illustrates an assembly 20 comprising a device 10 and a case 22 in which the frame and the fabric 14 are intended to be accommodated. The handle member 16 includes a free edge 24 applied to and sealingly engaging a free edge 26 (FIG. 1B) of the case 22 by means of an annular seal 28 (FIG. 3). The handle member 16 includes side tabs 30 for hooking onto complementary portions of the case 22 in order to secure the case 22 to the handle member 16 (FIGS. 1B and 2). Thus, when the frame 12 and the fabric 14 are accommodated in the case 22 and the case 22 performs a sealing function with the handle element 16, the assembly 20 (FIG. 1B) thus formed can be placed in a bag, an inner pocket of a jacket or a pocket of a pair of pants, without the residual drops present on the fabric 14 coming out and wetting the objects in contact with the assembly 20.

It is observed that the case 22 as well as the handle member 16 have a rectangular parallelepiped shape having a length or height 11, a width 12 and a thickness 13. The length 11 is greater than the width, which is itself greater than the thickness 13. It will later be understood that the proposed shape of the case formed by the case 22 and the handle element 16 is enabled by the use of specific deployment/closure kinematics of the ribs $B_1$, $B_2$, $B_3$, $B_4$ (FIG. 2) and by a relative arrangement of the ribs $B_1$, $B_2$, $B_3$, $B_4$ with respect to each other, allowing for an increased compactness of the device 10 in the closed position compared to devices of the prior art.

FIG. 2 depicts the frame 12 together with the handle element 16, the case 22 and the fabric 14 not being shown in order to visualize the frame 12 of the device 10 in its first closed position. The frame 12, according to the present disclosure, thus comprises a mast 18 which is telescopic here but which could also be non-telescopic so that the present disclosure also covers non-telescopic masts. The telescopic mast 18 thus comprises five tube portions 181, 182, 183, 184, 185 engaged with each other. The mast 18 has a transverse section, i.e., in a plane perpendicular to the longitudinal axis L of the mast 18, of generally oblong shape.

Figure 8:
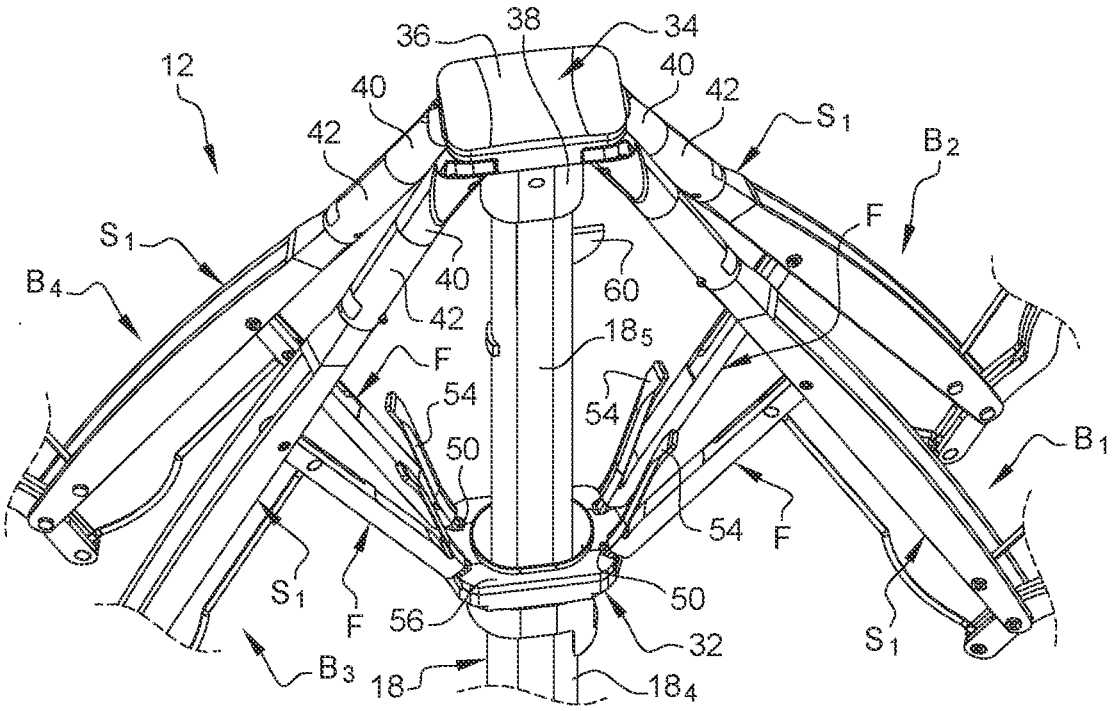
FIG. 8 is a larger scale schematic perspective view of the area outlined in the dotted line in FIG. 7.
Figure 9:
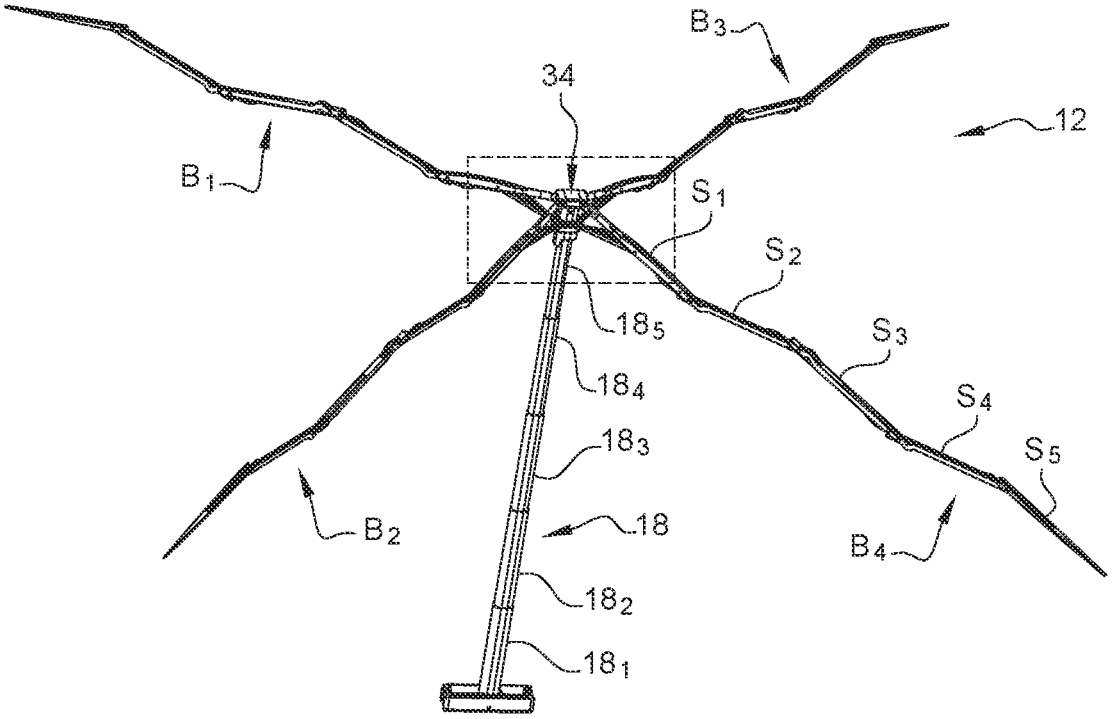
FIG. 9 is a schematic perspective view of the device, in a final position of deployment of the frame.
Figure 10:
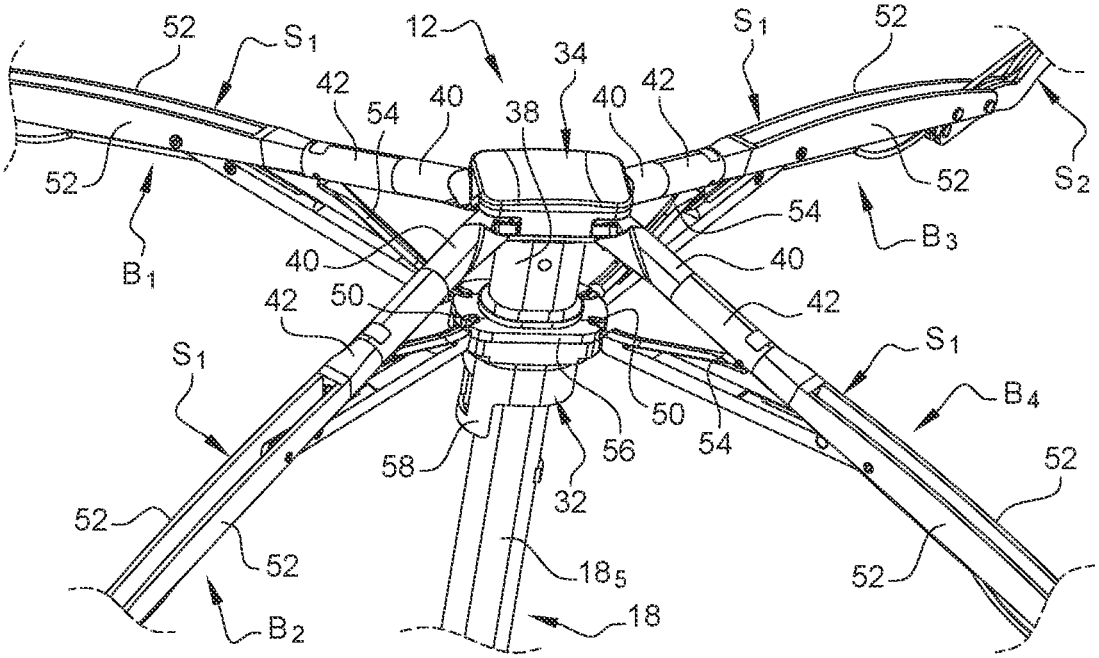
FIG. 10 is a larger scale schematic perspective view of the area outlined in the dotted line in FIG. 9.
Figure 11:
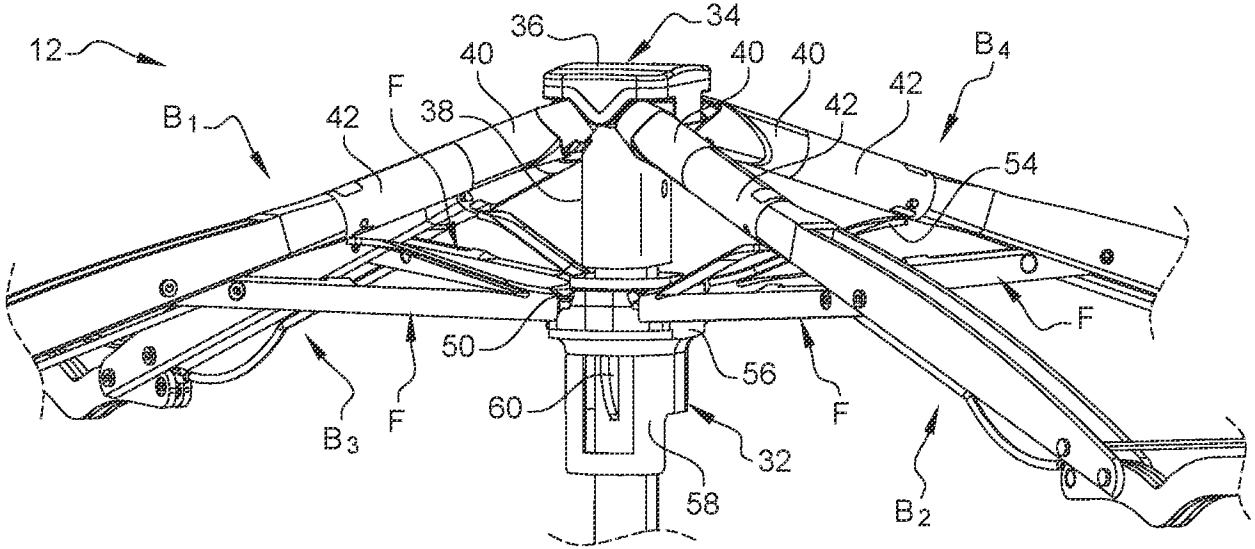
FIG. 11 is a schematic perspective view similar to that of FIG. 9 with a different angular orientation.

A runner 32 is mounted around the mast 18 and configured to slide along the longitudinal axis L of the mast 18 between the first closed position of the frame 12 (FIGS. 2 and 3) and a second open or deployed position of the frame 12 (FIGS. 9 to 11). As can be seen in FIGS. 2 to 10, the frame 12 comprises four ribs noted $B_1$, $B_2$, $B_3$, $B_4$. Each rib $B_1$, $B_2$, $B_3$, $B_4$ is associated and connected to a stretcher F which is connected to the runner. Furthermore, each rib $B_1$, $B_2$, $B_3$, $B_4$ is connected to a notch 34 or support integral with the end of the mast 18 which is opposite that carrying the handle element 16. Since the mast 18 is telescopic, the notch 34 is integral with one end of the tube portion 185 that is located radially further inward relative to the other tube portions (FIGS. 2, 5 and 8). It can be seen that the notch 34 comprises an upper base 36 connected to a tube portion 38 which is also oblong in shape and surrounds (but could be the reverse) and is attached to the end of the tube portion 185.

Figure 12:
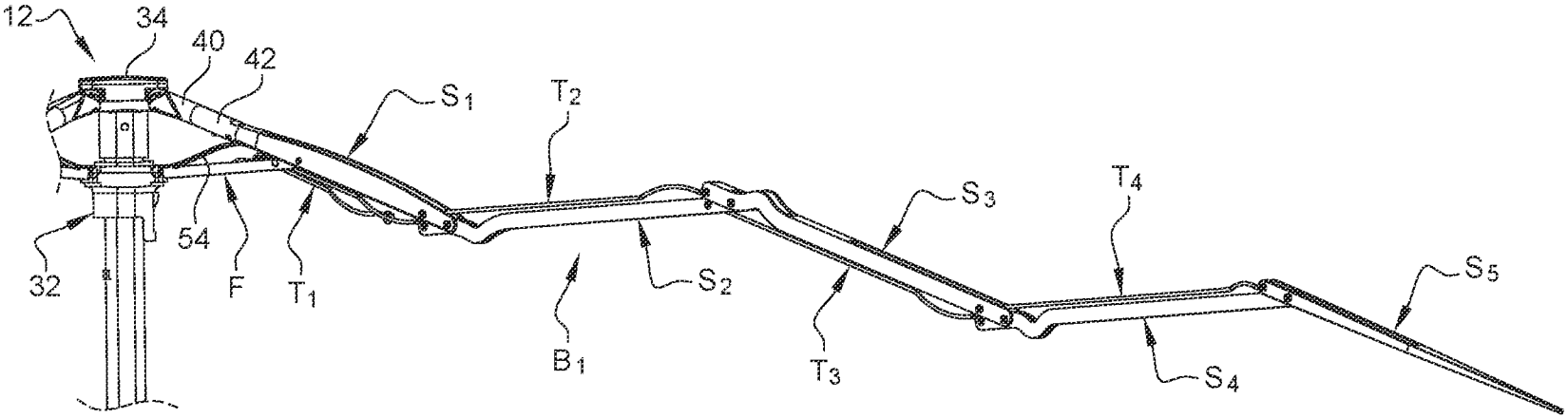
FIG. 12 is a schematic perspective view of a rib of a device according to the present disclosure.

As can be seen, each rib $B_1$, $B_2$, $B_3$, $B_4$ comprises n segments S arranged one after the other from a first segment $S_1$ to an n-th segment $S_n$ (FIGS. 9 and 12). The first segment $S_1$ of each rib $B_1$, $B_2$, $B_3$, $B_4$ is formed by a first part 40 and a second part 42 which are movable with respect to each other around the extension axis of the first segment $S_1$ (FIGS. 5, 6, 8 and 10). The structure of each rib $B_1$, $B_2$, $B_3$, $B_4$ will be described in more detail later, with reference to FIGS. 12 and 13.

As can be seen in FIGS. 5, 6, 8, 10 and 11, one end of the first portion 40 of the first segment $S_1$ of each rib $B_1$, $B_2$, $B_3$, $B_4$ is connected by a pivotal connection about a pivot connection around an axis $P_{B_1}$, $P_{B_2}$, $P_{B_2}$ and $P_{B_2}$ which are each perpendicular to a plane inclined obliquely to the longitudinal axis L of the mast 18. The other end of the first part engages an end of the second part and the first part and second part are rotatable relative to each other about the extension axis of the segment $S_1$. The term "pivot axis" or "axis" in connection with a pivot connection refers both to the material element serving as a pivot which is centered on the immaterial axis and to the material axis or rod as such. The first part 40 of the first segment $S_1$, and also the segment $S_1$ as such of the rib $B_1$, are rotatably articulated on the notch about a pivot axis $P_{B_1}$ perpendicular to a plane $P_1$ inclined obliquely with respect to the longitudinal axis L of the mast 18. The first part 40 of the first segment $S_1$, and also the segment $S_1$ of the rib $B_2$, are articulated in rotation on the notch about a pivot axis $P_{B_2}$ perpendicular to a plane $P_2$ inclined obliquely with respect to the longitudinal axis L of the mast 18. The first part 40 of the first segment $S_1$, and also the segment $S_1$ as such of the rib $B_3$, are articulated in rotation on the notch about a pivot axis $P_{B_2}$ perpendicular to a plane inclined obliquely with respect to the longitudinal axis L of the mast 18. The first portion 40 of the first segment $S_1$, and also the segment $S_1$ as such of the rib $B_4$, are rotatably articulated to the notch 34 about a pivot axis (not shown) perpendicular to a plane obliquely inclined with respect to the longitudinal axis L of the mast 18. More particularly, it is observed that the first rib $B_1$ (FIG. 4) is symmetrical to the second rib $B_2$ with respect to a plane A containing the longitudinal axis L of the mast 18 and passing between the first rib $B_1$ and the second rib $B_2$. Also, the axis $P_{B_1}$ of the pivot connection of the first rib $B_1$ and the axis $P_{B_2}$ of the pivot connection of the second rib $B_2$ are contained in the same plane B parallel to the longitudinal axis of the mast 18. The third rib $B_3$ is symmetrical to the fourth rib $B_4$ with respect to a plane C containing the longitudinal axis L of the mast 18 and passing between the third rib $B_3$ and the fourth rib $B_4$. Also, the axis $P_{B_2}$ of the pivot connection of the third rib $B_3$ and the axis $P_{B_1}$ of the pivot connection of the fourth rib $B_4$ are contained in the same plane D parallel to the longitudinal axis L of the mast. Thus, the plane B and the plane D are parallel to each other. Also, the first rib $B_1$ is symmetrical to the third rib $B_3$ with respect to a plane E containing the longitudinal axis L of the mast 18 and passing between the first rib $B_1$ and the third rib $B_3$. The second rib $B_2$ is symmetrical to the fourth rib $B_4$ with respect to a plane F containing the longitudinal axis L of the mast 18 and passing between the second rib $B_2$ and the fourth rib $B_4$. Due to the above symmetries, the plane A and the plane C are merged and so are the planes E and F.

Figure 6:
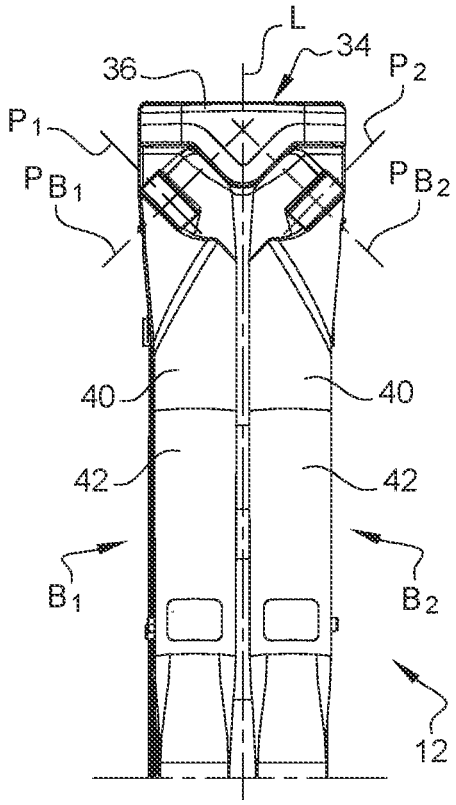
FIG. 6 is a schematic perspective view from another side of the device.
Figure 7:
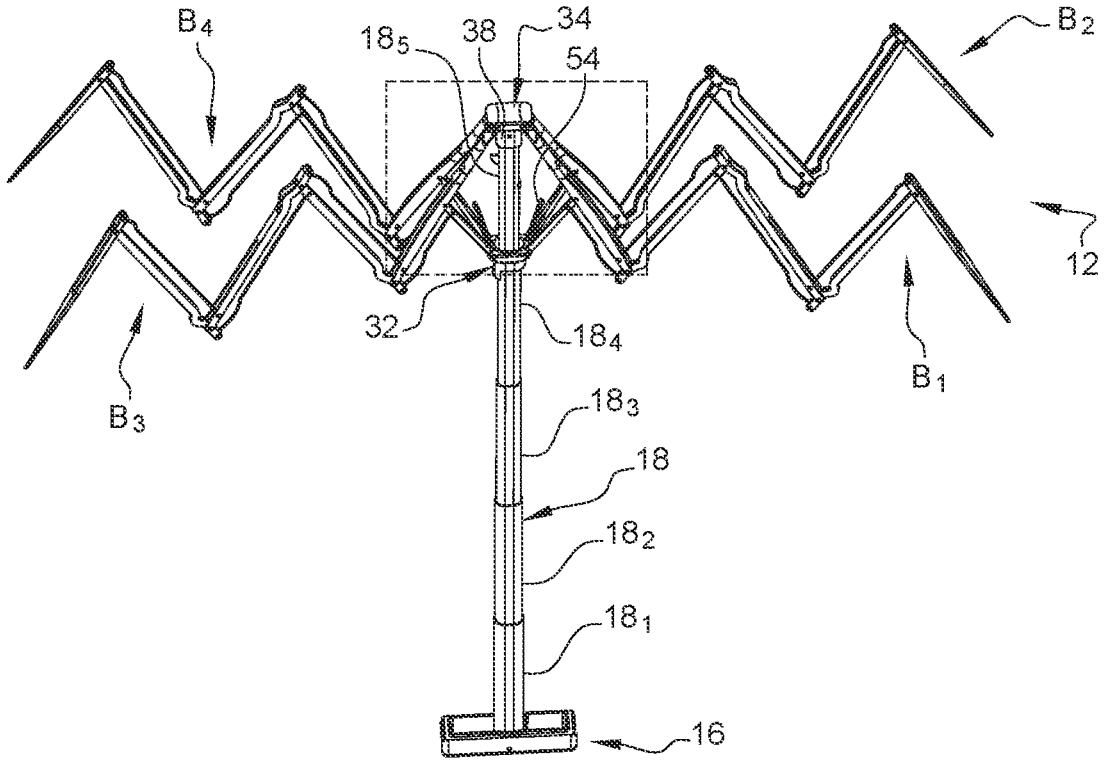
FIG. 7 is a schematic perspective view of the device, in an intermediate position of deployment of the frame.

FIG. 6 being a side view of the ribs $B_1$ and $B_2$ only, and in a direction perpendicular to the longitudinal direction L of the mast, it is understood that the oblique planes $P_1$ and $P_2$ are perpendicular to the plane of the page.

In an example, the axes $P_{B_1}$ and $P_{B_2}$ form an angle of approximately 45° with plane A (FIG. 6). Similarly, the axes $P_{B_2}$ and PBA form an angle of approximately 45° with plane C (FIGS. 4 to 6).

Figure 4:
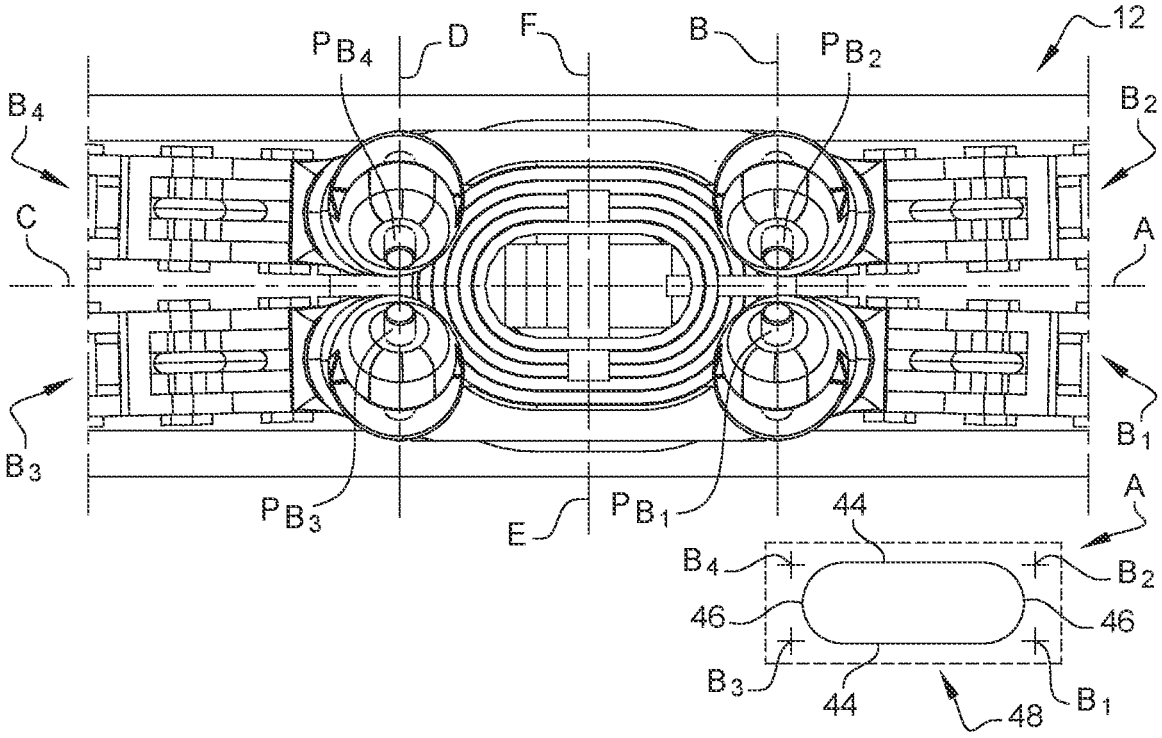
FIG. 4 is a view of the device of FIG. 2 in angular orientation from one end of a mast of the device, this FIGURE also including a part A illustrating the oblong shape of the mast.
Figure 5:
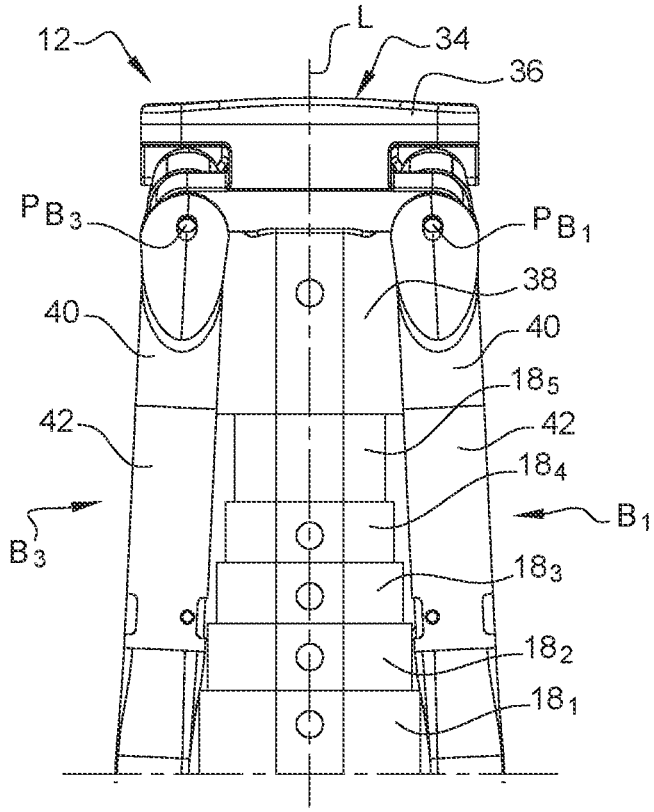
FIG. 5 is a schematic side and perspective view of the device.

The mast 18 has a generally oblong cross-section comprising two opposing planar surfaces 44 part A of FIG. 4 facing to each other and connected to each other by two rounded surfaces 46. The axis of the pivotal connection of the first rib $B_1$ and the axis of the pivotal connection of the second rib $B_2$ are in the vicinity of one of the two rounded surfaces 46. In this configuration, the first rib $B_1$ and the second rib $B_2$ are thus arranged side by side when the frame 12 is in its first closed position. The axis of the pivot connection of the third rib third rib $B_3$ and the axis of the pivot connection of the fourth rib $B_4$ are arranged in the vicinity of the other 46 of the two rounded surfaces. In this manner, the third rib $B_3$ and the fourth rib $B_4$ are arranged side by side when the frame 12 is in its first closed position. It is understood that the frame 12 offers, seen from above, i.e. along the axis L of the mast 18 and from the notch 34 (FIG. 4), thus a substantially rectangular general shape 48 when it is in its second position, each rib being arranged in the corners of the rectangular shape. This positioning of the pivot axes of the ribs $B_1$, $B_2$, $B_3$, $B_4$ relative to the mast allows the frame to be inserted into a rectangularly shaped case as shown in FIG. 2. This further allows the frame 12 to be more compact in the direction of the small dimension of the oblong shape.

Each stretcher F comprises a first end connected to the runner 32, more particularly by a ball-and-socket connection, as illustrated in FIGS. 8, 10 and 11, and a second end connected by a pivotal connection to the second part 42 of the first segment $S_1$ of each rib. More particularly, the first end of each stretcher F carries a spherical portion 50 engaged in a cavity of complementary shape of the runner 32. The second end of each stretcher F is pivotally inserted between two arms 52 of the second part 42 of the first segment $S_1$ of each rib.

As can be seen, each stretcher F also comprises elastic means which, in the particular case illustrated in the FIGURES and better visible in FIGS. 8, 10 and 11, take the form of an elastic tongue 54. This elastic tongue 54 is carried by the first end of the stretcher F and extends towards the second end of the stretcher F so as to form an angle with the stretcher F. In other words, the tongue 54 moves away from the stretcher F towards the second end of the stretcher F. Thus shaped, this tongue 54 allows to exert a elastic force against the mast 18, more particularly against the tube portion 181 of the mast 18, which allows to induce a pre-deployment of the frame 12 from its first closed position thus allowing the user to more easily access the runner and to be able to manipulate it to move it from its first position to its second position.

According to the present document, the specific connection of each stretcher F by a pivot connection to the runner 32 and to a second part 42 of a segment $S_1$ of a rib, which second segment 42 is able to pivot relative to a first segment 40 hinged on an oblique pivot axis, allows the ribs $B_1$, $B_2$, $B_3$, $B_4$ to move away from each other from the first position (FIGS. 4, 5 and 6) to the second position (FIGS. 9, 10 and 11).

The runner 32 (FIG. 11) comprises a first upper annular portion 56 comprising the housings or cavities for receiving the spherical parts 50 and a lower portion 58 comprising a recess for receiving a high spring 60 for locking the runner 32 in the second position of the frame 12.

We now refer to FIG. 12 which represents the rib $B_1$ connected to the mast 18 and to the runner according to the aforementioned means. The different parts of a rib are illustrated in FIG. 13, this rib being able to be indifferently the rib $B_1$, $B_2$, $B_3$ or $B_4$.

Each rib comprises n segments S arranged end to end from the first segment $S_1$ to an n-th end segment $S_n$, and:

for any $k \in [2, n-1]$ the k-th segment $S_k$ is connected to the segment $S_{k-1}$ by a pivot axis $P_{S_{k-1}/S_k}$ and is connected to the segment $S_{k+1}$ by a pivot axis $P_{S_k/S_{k+1}}$, a rod $T_k$ is associated with the segment $S_k$ and is connected by a pivot axis $P_{T_k/S_{k-1}}$ and by a pivot axis $P_{T_k/S_{k+1}}$ respectively, to the segment $S_{k-1}$ and to the segment $S_{k+1}$ so that each segment $S_k$ form together with a rod $T_k$ a deformable parallelogram.

Figure 13:
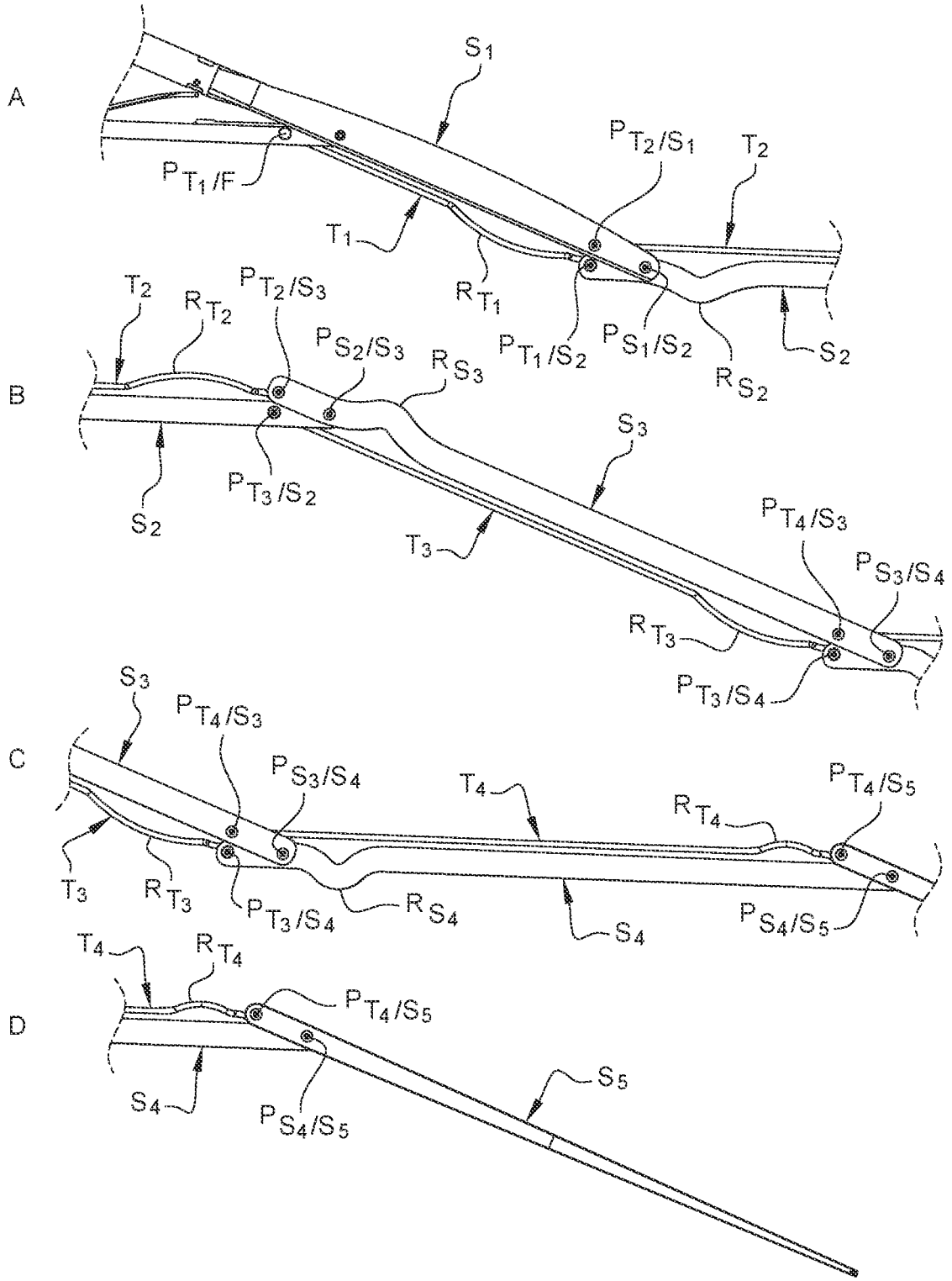
FIG. 13 is a schematic perspective view comprising four parts named FIG. 13A, FIG. 13B, FIG. 13C and FIG. 13D illustrating successively the different segments of the rib of FIG. 12.
Figure 14:
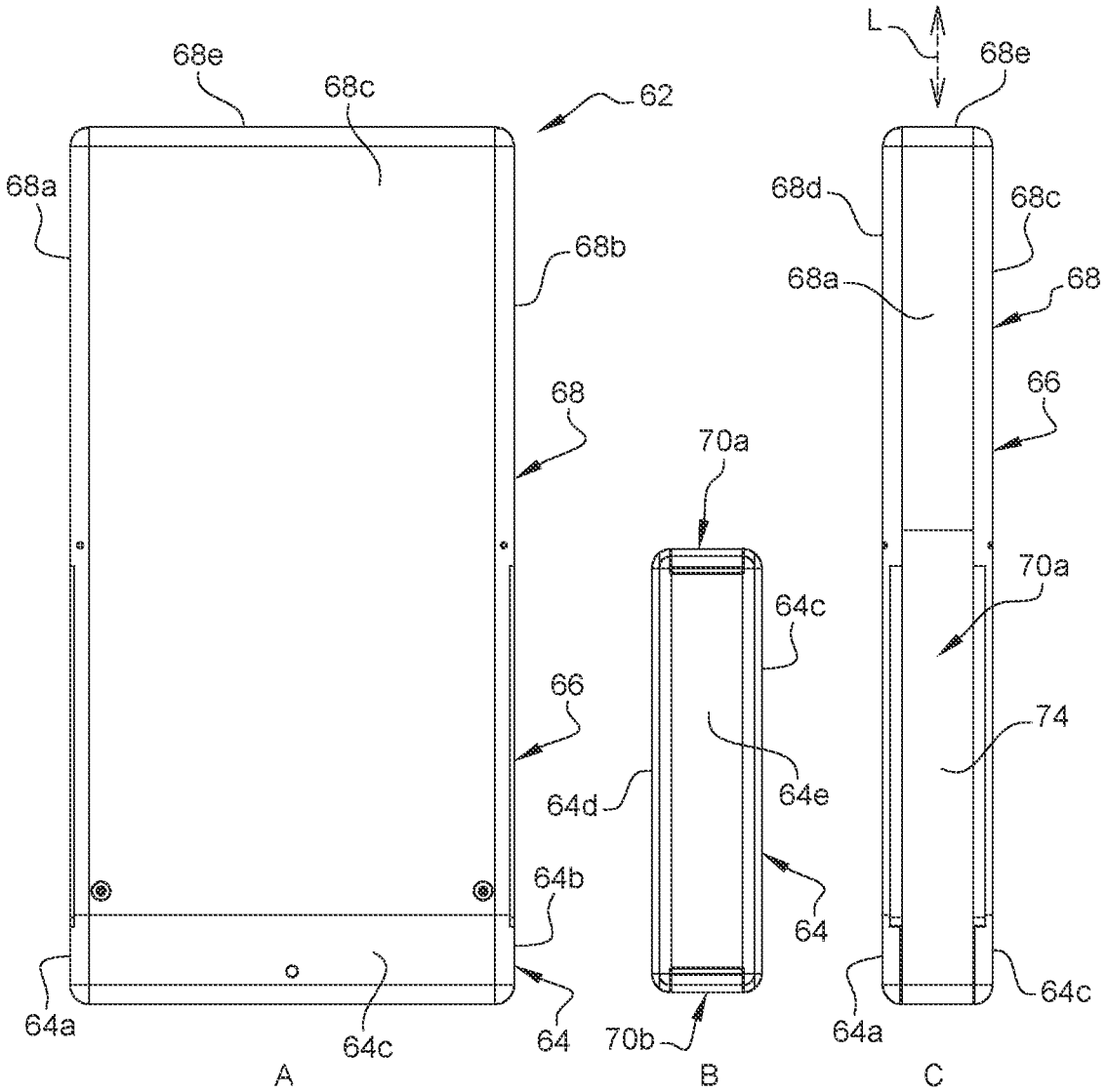
FIG. 14 is a schematic view of the waterproof casing according to the present disclosure, this FIGURE comprising a part A named FIG. 14A, a part B named FIG. 14B and a part C named FIG. 14C.

Here, in the case represented in the FIGURES and better visible in FIG. 13, each rib comprises 5 segments $S_1$, $S_2$, $S_3$, $S_4$, $S_5$ and it is observed that the segments $S_2$, $S_3$ and $S_4$ respect the above mentioned rule. It can be seen that the rods $T_2$, $T_3$, $T_4$ also comply with the aforementioned rule.

Similarly, the frame comprises a first rod $T_1$ pivotally connected to the stretcher by a pivot connection $P_{T_1/F}$ and pivotally to the second segment $S_2$ by a pivot pin $P_{T_1/S_2}$.

In order to realize a deployment and closing of each rib, the pivotal axes $P_{T_k/S_{k-1}}$, $P_{S_k/S_{k-1}}$ and $P_{T_{k-1}/S_{kk}}$ are positioned relative to each other so that the pivot axes are substantially aligned, the pivot axis $P_{S_k/S_{k+1}}$ being positioned between the pivot axis $P_{T_k/S_{k-1}}$ and the pivot axis $P_{T_{k-1}/S_k}$.

In FIG. 13, it can be seen that each k-th rod $T_k$ comprises a bulge $R_{T_k}$ for receiving the pivot axis $P_{T_{k+1}/S_k}$ and the pivot pin $P_{S_k/S_{k+1}}$ when the frame is in its first position (see also FIG. 3). Furthermore, each k-th segment $S_k$ comprises a bulge $R_{S_k}$ for receiving the pivot axis $P_{T_k/S_{k-1}}$ when the frame is in its first position. Also, the first rod $T_1$ comprises a bulge $R_1$ for receiving the pivot axis $P_{S_1/S_2}$ and the pivot axis $P_{T_2/S_1}$.

The present document thus relates to a deployable frame comprising one or more ribs. Thus, a configuration with four ribs makes it possible to deploy a canvas around one end of the mast and thus protect the user. This frame is advantageously portable. It could also be used as a non-mobile structure by a user moving around on foot and could, for example, be transportable and serve as an umbrella. Also, in another embodiment, the frame may comprise two ribs symmetrical to each other relative to plane A or plane C (FIG. 4). In such an embodiment, the fabric could comprise a first free edge and a second free edge which could be connected to a vertical structural element(s), such as a vertical plane, for example a wall, the mast being vertically oriented and arranged adjacent to or spaced from the vertical elements. The plane A or C may be vertically oriented and perpendicular to a vertical plane passing through the vertical elements. The deployment of the two ribs can thus lead to the two ribs moving away from the vertical structural elements, the fabric thus being angularly stretched from a first vertical element, a first rib, a second rib to the second vertical element. In this way, it can be imagined that the canvas has the shape of half a canvas of FIG. 1. Such a deployable structure could be used at a terrace of a drinking establishment, for example, for tables arranged next to a wall.

The fabric can be made of an elastically deformable material so that the fabric is little or lowly stretched when the frame is in its first closed position.

Reference is now made to FIGS. 14 to 17, which illustrate a waterproof casing 62 accommodating the previously described frame 12 but which could accommodate a different frame not described herein so that the description of the waterproof casing 62 may or may not be combined with the characteristics of the frame 12.

The parts identical to those previously described will not be described again and will bear the same references without limiting the content of the following description to the embodiment of FIGS. 1 to 13.

The case 62 shown in FIGS. 14 to 17 thus includes a handle element 64 and a case 66 which differ from those previously described in that the watertight attachment of these two parts is performed differently. Nevertheless, the dimensional description characteristics (length, width, and thickness) made previously and the consequences resulting therefrom are applicable to this case. This casing 62 is suitable for receiving any type of frame and in particular the one 12 described above.

The case 66 includes a fixed portion 68 and a first movable member 70*a* and a second movable member 70*b* which are movable between a first position for sealingly locking the handle element 64 with the case 66 and a second unlocking position for disengaging the handle element 64 from the case 66. The first movable member 70*a* and the second movable member 70*b* are symmetrical to each other with respect to a plane containing the longitudinal axis of the mast 18. The fixed portion 68 of the case 66 includes a first wall 68*a* and a second wall 68*b* extending in the direction of length 11 and thickness 13 and a third 68*c* and a fourth wall 68*d* extending in the direction of width 12 and length 11 or height. The first wall 68*a* and the second wall 68*b* are parallel to each other. The same is true of the third 68*c* and fourth 68*d* walls. These walls 68*a*, 68*b*, 68*c*, 68*d* are connected to each other by a bottom wall 68*e* or top wall.

The handle member 64 includes a first wall 64*a* and a second wall 64*b* extending in the direction of length 11 and thickness 13 and a third 64*c* and a fourth wall 64*d* extending in the direction of width 12 and length 11 or height. The first wall 64*a* and the second wall 64*b* are parallel to each other. The same is true of the third 64*c* and fourth 64*d* walls. These walls 64*a*, 64*b*, 64*c*, 64*d* are connected to each other by a bottom wall 64*e* or top wall.

One or more sealing pieces such as seals may be interposed between the case 66 and the handle member 64 but are not shown. The walls of each pair of third walls 68*c*, 64*c* of the case 66 and the handle member 64 and fourth walls 68*d*, 64*d* of the case 66 and the handle member 64 are aligned together in the longitudinal direction and provided to be placed end to end as seen in particular in FIG. 14.

Figure 15:
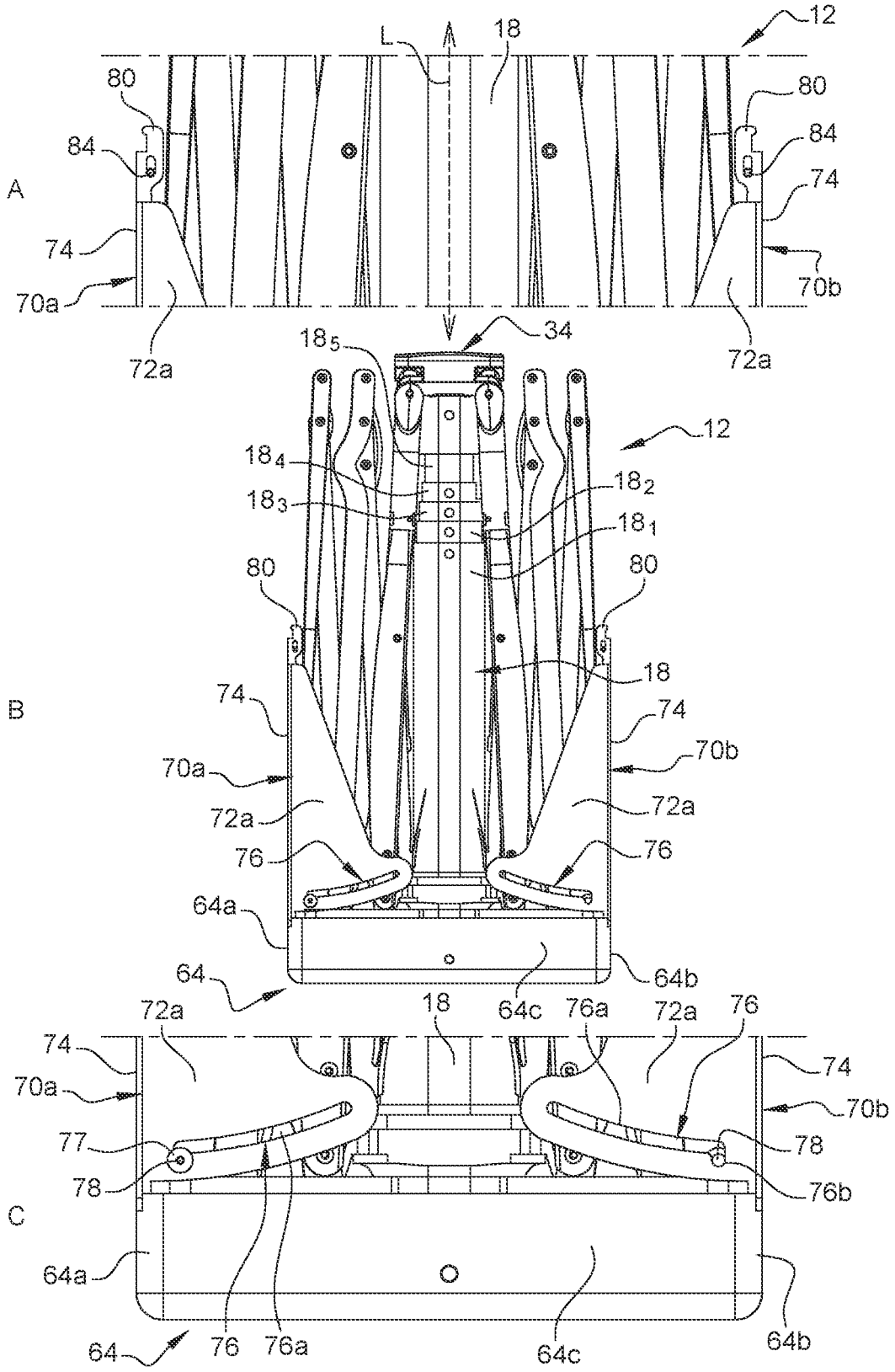
FIG. 15 is a schematic view of the waterproof casing according to the present disclosure in which a fixed portion of the case has been removed, this FIGURE comprising a part A named FIG. 15A, a part B named FIG. 15B and a part C named FIG. 15C.
Figure 17:
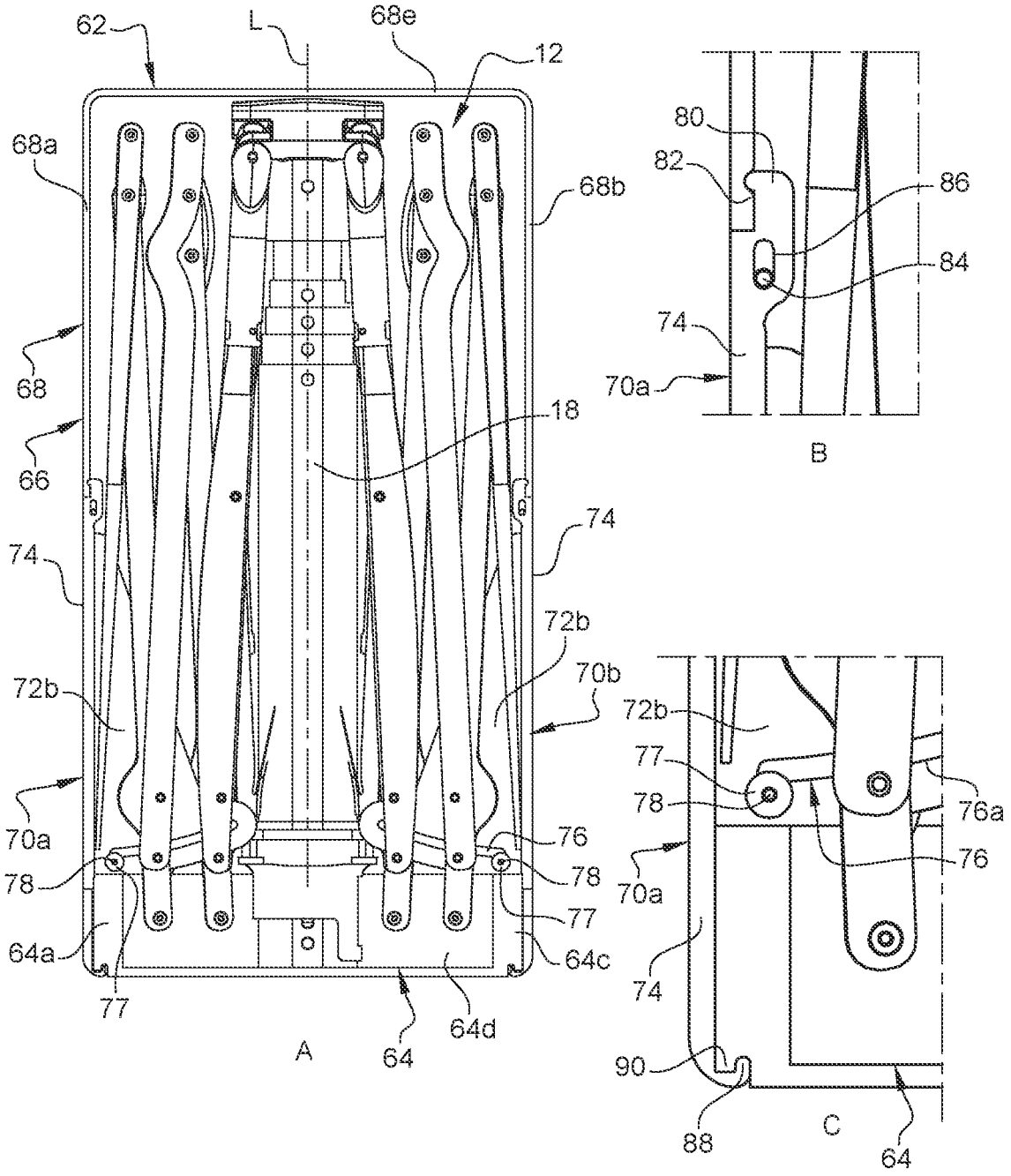
FIG. 17 is a schematic view of the waterproof casing according to the present disclosure illustrating more particularly elastic snap-fastening means at the case and handle element, this FIGURE comprising a part A named FIG. 17A, a part B named FIG. 17B and a part C named FIG. 17C.

Each movable member 70*a* includes a first web 72*a* and a second web 72*b* connected to each other by a wall element 74 (FIGS. 15 and 17). This wall element 74 may be shaped to be substantially aligned with the first wall 68*a* for the first movable member 70*a* and with the second wall 68*b* for the second movable member 70*b*. The description made with reference to one movable member is also valid for the other of the movable members.

In order to guide the first 70*a* and second 70*b* moving parts, guiding means are provided on the protective device.

Thus, each web 72*a*, 72*b* comprises a housing 76 having a first curved portion 76*a*, i.e., extending along an arc of a circle, which is connected at one end to a portion 76*b* oriented along the longitudinal axis L (FIGS. 15B and C). This housing 76 is here more particularly a slot, i.e. a housing passing through the web 72*a*, 72*b*. It is understood that a non-through housing, i.e. a groove, could provide the same guiding function. This being the case, the slot allows each guiding rod to be fixed to the third wall and the fourth wall of the case as shown in the FIGURES. According to the present document, a lower rod or second rod 78 is engaged by one end in the housing 76 of the first web 72*a* and for the other opposite end in the housing 76 of the second web 72*b*. This second or lower rod 78 is fixed to the third and fourth walls 68*c*, 68*d* of the case 66. In FIG. 15C, it is observed that there is a means of attachment 77 of the lower rod 78 of the first web 72*a* of the first movable member 70*a* to the third wall 68*c*, whereas this means of attachment has been removed (for ease of reading) from this FIGURE (but exists) with respect to the lower rod 78 of the first web 72*a* of the second movable member 70*b*.

Figure 16:
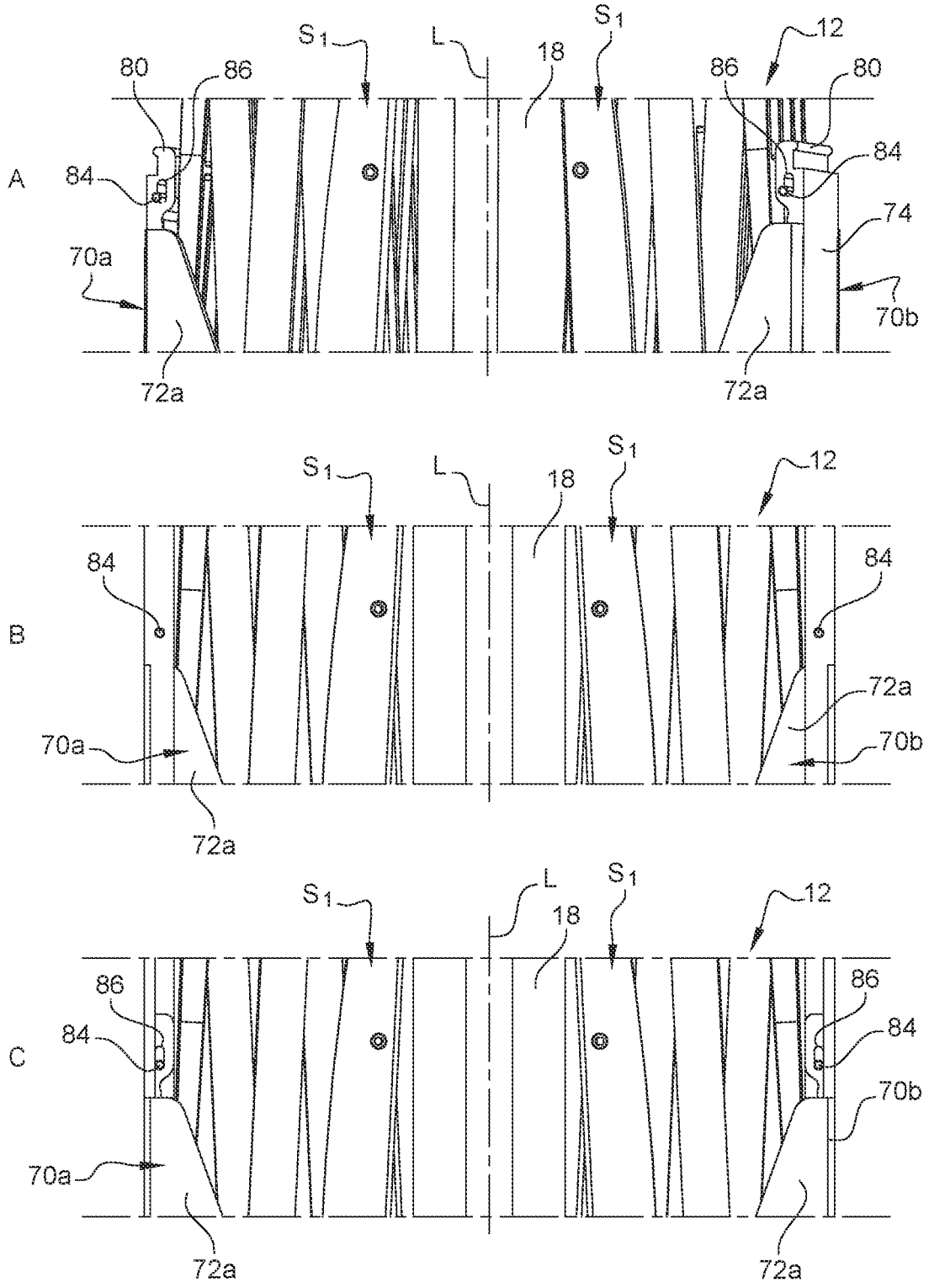
FIG. 16 is a schematic view of the cooperation between a movable part of the case and a fixed part of the case, this FIGURE comprising a part A named FIG. 16A, a part B named FIG. 16B and a part C named FIG. 16C.

The wall element 74 of each movable member 70*a*, 70*b* may comprise a first upper hook 80 capable of cooperating by elastic snap-fastening with a first hook 82 of complementary shape of the fixed portion 68 of the case 66 when the movable member 70*a*, 70*b* is in its first position so as to lock the movable member 70*a*, 70*b* on the fixed portion 68 of the case 66 along the longitudinal direction (FIGS. 15A, 16 and 17B). It is observed that the upper end or first end of the wall element 74 of the movable member 70*a*, 70*b* is slidably guided along the longitudinal direction L by means of an upper rod 84 or first rod, the ends of which are fixed to the third and fourth walls 68*c*, 68*d* of the fixed portion 68 of the case 66 and which is engaged in a slot 86 of the first end or upper end of the wall element 74 (FIGS. 16*a* and 17B).

Furthermore, each movable member 70*a*, 70*b* comprises a second lower hook 88 formed at a second end of the wall element 74 along the longitudinal direction L. This second hook 88 is adapted to elastically snap-fastening with a second hook 90 of complementary shape of the handle element 64 when the movable member is in its first position so as to block a movement of the movable member 70*a*, 70*b* along a direction perpendicular to the longitudinal direction L.

After the deployable frame is moved to its first closed position, the opening of the case 66 is presented at the notch 34 of the frame 12 and the frame 12 is inserted into the case 66 until the third walls 68*c*, 64*c* of the case 66 and the handle member 64 and the fourth walls 68*d*, 64*d* of the case 66 and the handle member 64 come into contact, optionally via one or more seals. The movable members 70*a*, 70*b* being in their second unlocking position (not shown), these are displaced by pivoting about the first rods so as to come into an intermediate position in which the second rods 78 are able to slide longitudinally in the second portions 76*b* of the housings 76, the first rods 84 then also being allowed to slide in the slots 86 of the first ends of the wall elements 74 of the movable members 70*a*, 70*b*.

The invention claimed is:

1. A deployable frame for a bad weather and/or sun protection device, comprising:

a mast with a longitudinal axis on which a runner is mounted so as to slide between a first position in which the frame is closed and a second position in which the frame is open;

at least one rib connected by a stretcher to the runner, the rib comprising an end connected to a notch carried by one end of the mast, wherein the rib comprises a first segment formed of a first part and a second part that are movable relative to each other about the extension axis of said first segment, the first part of the first segment of the rib is connected to the notch by a pivot connection about an axis which is perpendicular to a plane inclined obliquely to the longitudinal axis of the mast so that in the first position of the frame the first segment of the rib extends along the mast and in the second position of the frame the first segment of the rib is moved away from the mast.

2. The frame of claim 1, wherein a first end of the stretcher is connected to the runner by a ball-and-socket connection.

3. The frame of claim 2, wherein the ball-and-socket connection comprises a spherical portion carried by the first end of the stretcher and housed in a complementarily shaped cavity of the runner.

4. The frame according to claim 1, wherein a second end of the stretcher is pivotally connected to the second part of the first segment of the rib.

5. The frame according to claim 1, wherein the frame comprises resilient means configured to exert a force tending to deploy the frame when the frame is in its first position.

6. The frame according to claim 5, wherein the resilient means comprises a resilient member interposed between the first segment and the mast when the frame is in its first position.

7. The frame according to claim 5, wherein the resilient means comprises a tongue carried by the stretcher and resiliently constrained between the stretcher and the mast when the frame is in its first position.

8. The frame according to claim 1, wherein the rib comprises n segments S arranged at the end of each other from the first segment $S_1$ to an n-th end segment $S_n$, and wherein:

for any $k \in [2, n-1]$ the k-th segment $S_k$ is connected to the segment $S_{k-1}$ by a pivot axis $P_{S_{k-1}/S_k}$ and is connected to the segment $S_{k+1}$ by a pivot axis $P_{S_k/S_{k+1}}$, a rod $T_k$ is associated with the segment $S_k$ and is connected by a pivot axis $P_{T_k/S_{k-1}}$ and by a pivot axis $P_{T_k/S_{k+1}}$ respectively, to the segment $S_{k-1}$ and to the segment $S_{k+1}$ in such a way that each segment $S_k$ together with a rod $T_k$ forms a deformable parallelogram.

9. The frame of claim 8, wherein each k-th rod $T_k$ comprises a bulge $R_{T_k}$ for receiving the pivot axis $P_{T_{k+1}/S_k}$ and the pivot axis $P_{S_k/S_{k+1}}$ when the frame is in its first position.

10. The frame according to claim 8, wherein each k-th segment $S_k$ comprises a bulge $R_{S_k}$ for receiving the pivot axis $P_{T_k/S_{k-1}}$ when the frame is in its first position.

11. The frame according to claim 8, wherein the pivot axes $P_{T_k/S_{k-1}}$, $P_{S_{k-1}/S_k}$ and $P_{T_{k-1}/S_k}$ are positioned relative to each other such that said pivot axes are substantially aligned when the frame is in its first position, the pivot axis $P_{S_{k-1}/S_k}$ being positioned between the pivot axis $P_{T_k/S_{k-1}}$ and the pivot axis $P_{T_{k-1}/S_k}$.

12. The frame according to claim 8, in which the frame comprises a first rod connected pivotally by a pivot connection to the stretcher and pivotally to the second segment by a pivot axis $P_{T_1/S_2}$.

13. The frame according to claim 12, wherein said first rod comprises a bulge for receiving the pivot axis $P_{S_1/S_2}$ and the pivot axis $P_{T_2/S_1}$.

14. The frame according to claim 1, wherein the frame comprises a first rib and a second rib, the first rib being symmetrical to the second rib with respect to a plane containing the longitudinal axis of the mast and passing between the first rib and the second rib.

15. The frame of claim 14, wherein the axis of the pivot connection of the first rib and the axis of the pivot connection of the second rib are contained in the same plane parallel to the longitudinal axis of the mast.

16. The frame according to claim 15, wherein the mast has a generally oblong cross-section comprising two surfaces facing each other and connected to each other by two rounded surfaces, and wherein the axis of the pivot connection of the first rib and the axis of the pivot connection of the second rib are arranged in the vicinity of one of the rounded surfaces.

17. The frame according to claim 14, wherein the frame comprises a third rib and a fourth rib, the third rib being symmetrical to the fourth rib with respect to a plane containing the longitudinal axis of the mast and passing between the third rib and the fourth rib.

18. The frame of claim 17, wherein the axis of the pivot connection of the third rib and the axis of the pivot connection of the fourth rib are contained in the same plane parallel to the longitudinal axis of the mast.

19. The frame according to claim 18, wherein the mast has a generally oblong cross-section comprising two surfaces facing each other and connected to each other by two rounded surfaces, and wherein the axis of the pivotal connection of the third rib and the axis of the pivotal connection of the fourth rib are arranged in the vicinity of one of the rounded surfaces.

20. The frame according to claim 14, wherein the first rib is symmetrical to a third rib with respect to a plane containing the longitudinal axis of the mast and passing between the first rib and the third rib.

21. The frame according to claim 14, wherein the second rib is symmetrical to a fourth rib with respect to a plane containing the longitudinal axis of the mast and passing between the second rib and the fourth rib.

22. The frame according to claim 1, wherein the mast has a generally oblong cross-section comprising two surfaces facing each other and connected to each other by two rounded surfaces.

23. A bad weather and/or sunlight protection device comprising at least one frame according to claim 1, and a protective cloth attached to said frame so as to be put under tension when said frame is brought into its second position.

24. The device of claim 23, wherein a handle member is mounted at an end of the mast opposite that receiving the notch.

25. The device of claim 23, further comprising a case adapted to be mounted around the frame when the frame is in its first position, the case sealingly cooperating with the handle member so as to form a sealed casing.

* * * * *